United States Patent [19]

Goss

[11] Patent Number: 4,654,109

[45] Date of Patent: Mar. 31, 1987

[54] HOT TROWEL DEVICE AND METHOD

[75] Inventor: Charles T. Goss, Glenshaw, Pa.

[73] Assignee: Goss, Inc., Glenshaw, Pa.

[21] Appl. No.: 752,085

[22] Filed: Jul. 5, 1985

[51] Int. Cl.[4] ..... F23C 5/02

[52] U.S. Cl. ..... 156/579; 126/229; 126/234; 126/401; 156/583.1

[58] Field of Search ..... 156/579, 157, 499, 497, 156/546, 544, 574, 583.1, 82; 126/229, 231, 234, 230, 403, 411, 237, 238, 401, 226

[56] References Cited

U.S. PATENT DOCUMENTS

| | | | |
|---|---|---|---|
| 1,509,236 | 9/1924 | Greene | 126/401 |
| 2,692,641 | 10/1954 | Woods | 126/401 |
| 2,698,653 | 1/1955 | Hollaway | 126/401 |
| 3,171,466 | 3/1965 | Katchur, Jr. | 126/401 |
| 4,176,657 | 12/1979 | Eriksson et al. | 126/401 |

*Primary Examiner*—Michael Wityshyn

*Attorney, Agent, or Firm*—Thomas H. Murray; Clifford A. Poff

[57] ABSTRACT

A hand trowel device for particular use in roofing and like constructions is specially provided with an integral heating means. The heating means is adapted to continuously maintain the trowel blade at a temperature sufficient to plasticize or render flowable, preferably under applied pressure, the roofing compound or roofing cement employed. The roofing compound to be plasticized may be pre-impregnated in or otherwise integrated with the roofing sheet (or "felt") material being used in the roof covering or it may be separately provided for the purpose of independently sealing and waterproofing the roof covering material, particularly lapped edge or flashed edge portions of sheet roof covering material. Also, since it is a hand trowel, the trowel device is provided with a convenient hand gripping portion to facilitate lifting, carrying and manipulating the trowel during use and, in addition, an attached safety stand for supporting the hot or heated trowel in a rest position elevated above the roof surface.

In use, the heated or hot trowel device is continuously maintained at a predetermined temperature to cause, on contact and under applied pressure, plastic flow of the roofing cement or roofing compound employed. The edges or edge portions of the trowel permit directing or redirecting the flow of the roofing compound, as desired, and the flat bottom surface of the trowel between its edges permits applying heat over relatively broad area to cause, in certain circumstances, softening of the compound to occur. By applying and appropriately manipulating the hot trowel from zone to zone on the sheet roofing material to be sealed, there is effected a desired smooth, finished, air-impermeable and water-tight seal.

3 Claims, 1 Drawing Figure

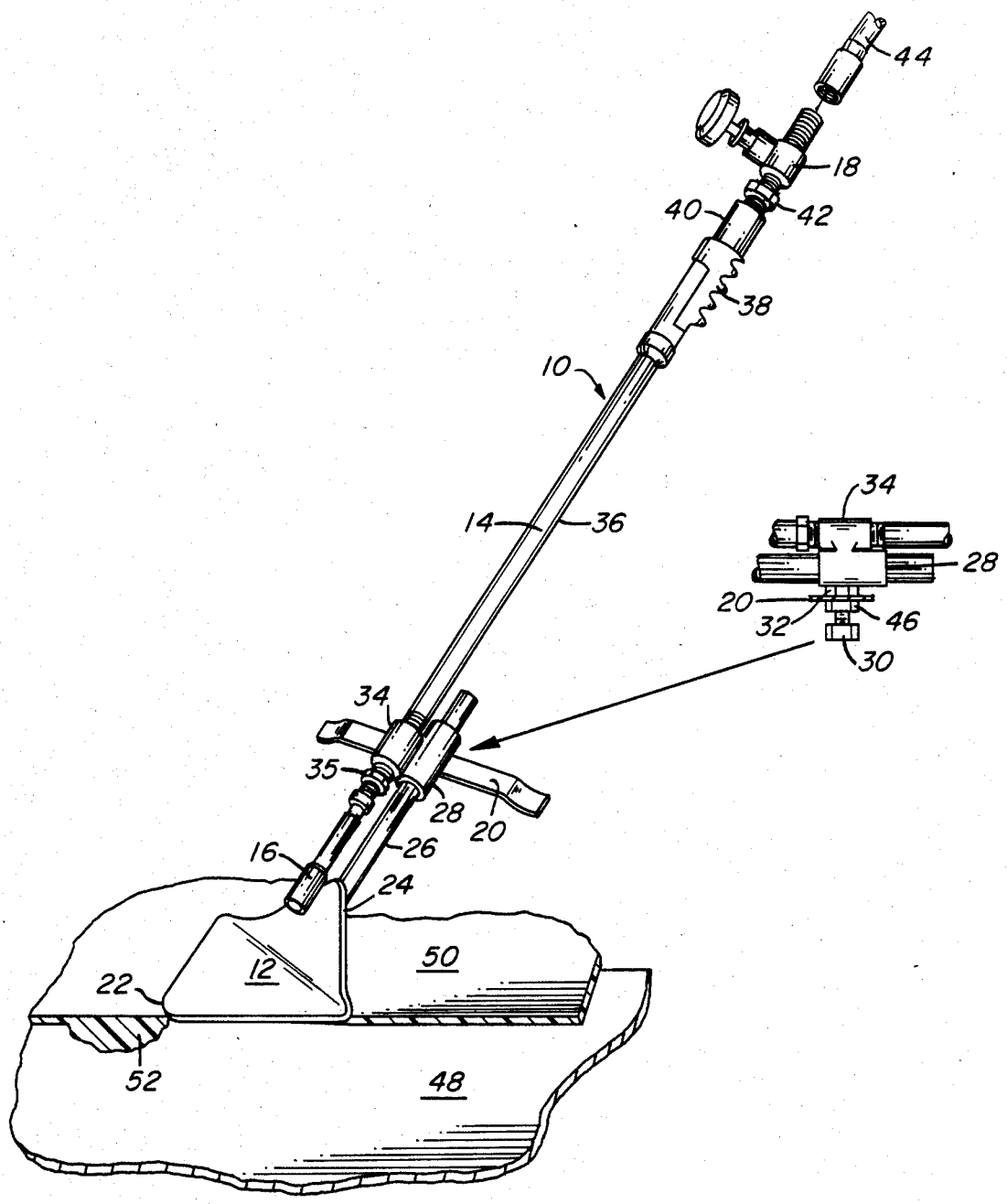
44
18
40
42
38
10
14
36
34
28
20
32
46
30
34
35
28
20
16
26
24
12
50
22
52
48

HOT TROWEL DEVICE AND METHOD

BACKGROUND OF THE INVENTION

1. Field of the Invention

This invention relates to air- and water-impermeable coverings for roofs or the like. More particularly, it relates to a roofing system employing for its air- and water-impermeable covering a plurality of elongated sheets of marginally edge lapped covering material and, in which, the sheets are designed to be adhesively or cohesively sealed together along their elongated marginal edge portions, as well as sealed to flashing or the like at appurtenant structures, either at the perimeter of or intermediate the perimeter of the surface to be covered. Specifically, the invention relates to the making and/or repairing of a roof or the like, in which, there are laid down on the surface to be covered a plurality of elongated sheets of heat-sealable roofing material, in overlapping relationship and, in particular, it relates to a method for finishing the seams between the above-mentioned sheets themselves, as well as between the sheets and chimneys, skylights, vent pipes, perimeter walls and the like, and to a device which is particularly suited and useful for the seam-finishing practice mentioned above.

2. Description of the Prior Art

In the making of a roof for a structure which has either a flat or low-sloping roof, there are generally at least three major systems that have been employed most extensively in the United States.

First, there are the asphalt (or "tar") and gravel roofs which are made with several alternating (or built-up) layers of roofing felt, each coated with hot- or cold-mopped asphalt. The roofing felt provides a water-resistant membrane sandwiched between the roof's sheathing and its surface. Made from wood fibers and recycled paper that have been saturated with asphalt oils, roofing felt prevents moisture, such as rain, from penetrating and damaging the sheathing. The uppermost layer of mopped felt is then generally surfaced with crushed rock or gravel (ballast). As recently as about ten years ago, roofs made by this cumbersome and time-consuming practice comprised nearly all of the flat or low-sloping roofs in the United States.

Second, there is the more recent practice of making rubber roofs, wherein elongated sheets of rubber are laid in suitable overlapping relationship, with the joints between the laps and elsewhere, where water penetration might occur, being provided with an elastic cement or an adhesive composition. Here, once again, a final layer of gravel or the like may be used, if desired.

Third, and more pertinent to the present invention, there is the approach wherein the surface to be covered is provided with a weatherproof membrane comprised of a plurality of sheets of a modified-bitumen-containing, heat-sealable roofing material. It is known to those skilled in the art how to make such roofing material, an example of which is "KMM" membrane manufactured and marketed by Koppers Company, Inc. of Pittsburgh, Pa. The Standard KMM membrane, for example, is a five-layer laminate composed of a thick, flexible, plastic core protected on each surface by a layer of modified bitumen material and an outer film of polyethylene.

Moreover, the prior art contains numerous suggestions of methods for roofing with heat-sealable roofing material of the type mentioned above. Generally, these methods include depositing, in edge-overlapping relation, on a surface to be roofed, such a heat-sealable roofing material and, then, with the use of an apparatus which lifts the overlapping portion between adjacent sheets, applying heat in the form of gaseous combustion products to the gap therebetween to an extent sufficient to allow the contact surfaces to be fused or sealably joined and, finally, pressing the heated contact surfaces together with sufficient force to sealably join the overlapping edge portions of the material. Examples of such disclosure and such equipment may be found in U.S. Pat. Nos. 2,084,625; 4,087,309; 4,204,904; 4,239,581 and 4,259,142 the disclosures which are incorporated herein by reference.

A further example of a device for applying such heat-sealable sheet material to a roof or other flat or nearly-flat surface area may be found in U.S. Pat. No. 4,354,893, the disclosure of which is also incorporated herein by reference. In accordance with this last-mentioned disclosure, a device is provided which applies, from a plurality of jets located in a row adjacent to the entire width-wise underside of the sheet being laid down, hot gases resulting from the combustion of hydrocarbon fuel, usually gaseous fuel, to said underside of the roofing material, thereby causing it to become tacky and adhesive to the surface portions with which it is substantially immediately thereafter brought into contact.

In the making of a roof with such heat-sealable or modified-bitumen-containing roofing material, there exists, as a usual and desirable step, an operation of finishing the seams that exist between the sheets of roofing material thus laid down. Though it is possible to omit this step, considering the roof finished either when the sheets of material have been laid down or after the subsequent application of a layer of gravel or the like, it is generally preferable or desirable to conduct a finishing operation, i.e., one in which oozed-out material is directed back into each seam between two overlapping sheets of heat-sealable roofing material. Conducting such a step is particularly important, whether or not a final layer of gravel is to be used. Experience reveals that, in such a seam between two sheets of heat-sealable roofing material, some parts of the seam have oozed-out material adjacent thereto and others do not. The places that do not, if nothing is done, afford places of weakness in the roof, i.e., locations in which, for example, the wind may work upon a location where the two sheets are not in contact and increase the extent of the area not in contact, a factor which is conductive to the ultimate failure of the roof.

Also, seams may occur in such roofing construction in zones or areas characterized by the presence of chimneys, skylights, vent pipes, building perimeter walls and the like. These additional seam zones or areas also require thorough sealing or finishing due to the same considerations as set forth above, i.e., separation of the roofing material occurring at the seam, causing ultimate failure of the roof through, for example, the ravages of wind, ice or rain.

Although the foregoing cited patents relate to the same general subject matter as the instant invention, namely, the laying of roofs of modified-bitumen-containing material or the like, they are not concerned with exactly the same problem that provides the focal point of this invention and they do not teach or suggest how it may be overcome. They are specifically more concerned with either applying heat to the overlapping edge portions of the sheets or applying heat to the sheet underside substantially throughout its width (i.e., U.S. Pat. No. 4,354,893) to get a good initial seal, rather than, as herein, to effecting the finishing of a defective seal, once made, by substantially uniformly redistributing therealong oozed-out material or adding additional material, so that no place exists along the seam that affords a place of weakness where, as aforesaid, wind or other forces may cause sheet separation and ultimate failure of the roof.

Perhaps the most important consideration in roofing is that there be obtained a roof which does not leak, either initially or after an extended period of service. Adequately performing a seam-finishing step, throughout the length of each seam, is an important safeguard toward obtaining the desired result, and this is true whether or not the seam edges are later to be protected from wind attack by the application of an overlying layer of gravel or the like. The tool and the method of the present invention, as well as that of applicant's co-pending application Ser. No. 728,808 filed Apr. 30, 1985, are useful for obtaining with a minimum of time, effort and cost, such an adequate seam-finishing operation, particularly for the laying of roofs of modified material which has, in its installation, been heated on its underside substantially throughout its width, for example, with a device of the kind more particularly shown in the U.S. Pat. No. 4,354,893, mentioned above. It is also believed that the approach of U.S. Pat. No. 4,354,893 necessarily gives better results, in respect to obtaining a leak-proof roof, than any method or device which involves merely the lifting and fusing of an edge portion of each lap, as taught in such references as U.S. Pat. No. 2,084,625, mentioned above.

SUMMARY OF THE INVENTION

In accordance with the present invention, a hand trowel device for use in roofing and like constructions is specially provided with an integral heating means. The heating means is adapted to continuously maintain the trowel blade at a temperature sufficient to plasticize or render flowable, preferably under applied pressure, the roofing compound or roofing cement employed. The roofing compound to be plasticized may be pre-impregnated in or otherwise integrated with the roofing sheet (or "felt") material being used in the roof covering or it may be separately provided for the purpose of independently sealing and waterproofing the roof covering material, particularly lapped edge or flashed edge portions of sheet roof covering material. Also, since it is a hand trowel, the trowel device is provided with a convenient hand gripping portion to facilitate lifting, carrying and manipulating the trowel during use and, in addition, an attached safety stand for supporting the hot or heated trowel in a rest position elevated above the roof surface.

In use, the heated or hot trowel device is continuously maintained at a predetermined temperature to cause, on contact and under applied pressure, plastic flow of the roofing cement or roofing compound employed. The edges or edge portions of the trowel permit directing or redirecting the flow of the roofing compound, as desired, and the flat bottom surface between its edges permits applying heat over a relatively broad area to cause, in certain circumstances, softening of the compound to occur. By applying and appropriately manipulating the hot trowel from zone to zone on the sheet roofing material to be sealed, there is effected a desired smooth, finished air-impermeable and water-tight seal.

DESCRIPTION OF THE DRAWING

A complete understanding of the invention may be obtained from the foregoing and the following description thereof, taken in conjunction with the appended drawing the FIGURE of which is a perspective view of a hot-trowel seaming tool in accordance with the present invention, and a detail view of a selected portion thereof.

DESCRIPTION OF THE PREFERRED EMBODIMENT

In the drawing, there is shown a preferred hot trowel device according to the invention that is particularly useful for practicing the seam finishing method of the invention.

As shown, the hot trowel device, indicated generally at 10, is comprised of a trowel blade 12, a handle or handle assembly 14, a gas burner or burner jet 16, a burner gas-control valve 18 and, preferably, a safety stand 20.

The trowel blade 12, depicted in the drawing, is about a $3\frac{1}{4}$ inch$\times 3\frac{1}{4}$ inch square piece of approximately 1/16 inch thick sheet steel having its corners slightly rounded and, in particular, having its front or nose corner 22 rounded to a substantially greater extent, e.g., about a $\frac{1}{4}$ inch radius, than that of its other three corners, e.g., about a $\frac{1}{8}$-inch radius. The trowel blade 12, as shown, is bent upward at about a 45 degree angle across its width at a location slightly aft of the two corners of the blade nearest to the nose corner 22, thus presenting an upwardly inclined tail portion 24. A trowel support arm 26 is affixed, as by welding, to the underside surface of upwardly inclined tail portion 24 of trowel blade 12.

In the embodiment shown, trowel support arm 26 is a five-inch-long straight piece of $\frac{1}{2}$-inch iron pipe, having about 1 inch of the forward end thereof attached or residing below the underside surface of upwardly inclined tail portion 24 of trowel blade 12. The distal or rearward end of trowel support arm 26, as shown, is loosely or slidingly received in a support arm coupling or collar member 28 which, for convenience and economy, may be a standard $\frac{3}{4}$ inch threaded pipe coupling. Coupling or collar member 28 is appropriately provided with a threaded or locking set screw 30 to permit, upon tightening of set screw 30, securely locking coupling or collar member 28 at a desired position along the free length of trowel support arm 26. Specifically, in the embodiment shown, the set screw attachment to coupling or collar member 28 is accomplished by drilling an appropriate sized transverse hole (not shown) through the wall of the pipe coupling 28, centrally of its length, and welding a threaded nut 32 over said hole and, then, threadedly receiving the set screw 30 in the threaded nut 32.

Proceeding further, with the aid of the drawing, shown diametrically opposite to set screw 30 and axially parallel to support coupling 28, there is affixed to coupling 28, as by welding, a burner or burner jet attachment coupling 34. In the particular arrangement shown, burner attachment coupling 34 is a standard or conventional $\frac{1}{2}$ inch (i.e., inside diameter) threaded black iron pipe coupling welded to the forward end portion of support arm coupling 28. Threadedly connected to the forward end of coupling 34, by a $\frac{1}{2}$-inch to $\frac{3}{8}$-inch black iron pipe adapter 35, is the burner or burner jet 16, of brass and of a conventional construction. As thus disposed, burner or burner jet 16 is axially directed to the approximate middle or center of the upper area of trowel blade 12.

On the other hand, threadedly connected to the rearward end of burner coupling 34 is an approximately 9-inch-long straight section of standard ½-inch threaded black iron pipe, which serves as a rigid gas supply conduit 36 for burner 16, as well as providing a convenient member to grip by hand for the purpose of using and manipulating the entire hot trowel device 10 of this invention. A desirable hand grip 38, of appropriately molded rubber or plastic or the like, is also shown affixed near the rearward or distal end of gas supply conduit 36 from its attachment to burner attachment coupling 34. Thence, there is shown, in sequence, attached to the rearward or free end of gas supply conduit 36, a ½-inch black iron pipe coupling 40, a ½ to ⅜ inch black iron pipe adapter 42 and gas flow valve 18, of brass and of a conventional construction. Of course, the gas supply (not shown) is preferably attached to valve 18 by means of flexible hosing, such as depicted at 44.

In addition to the basic structure described above, it is desirable to provide the hot trowel device 10 of this invention with a safety stand, shown at 20, to permit safely resting the hot trowel device in either a lit or unlit condition on a convenient horizontal or flat working surface during use, as well as to protect the burner jet from accidental damage or contact with contaminating material. For this purpose, hot trowel device 10 has affixed thereto, by an appropriate lock nut 46 carried on set screw 30, the desired safety stand 20. Safety stand 20 conveniently comprises, in the embodiment shown, an essentially inverse U-shaped, ¾-inch wide strip of approximately ⅛-inch thick steel, drilled centrally thereof to permit passage therethrough of set screw 30, with the legs of the U-shaped member being directed downward and the distance between said legs being on the order of about 7 inches apart, more or less, to provide adequate stability. It will also be understood that, by slightly releasing lock nut 46, safety stand 20 may be rotated into longitudinal, parallel, alignment with attached trowel support coupling member 28, so that lock nut 46 can then be retightened to secure or store safety support stand 20 in a more out-of-the-way position during use of hot device trowel 10.

In operation, the hot-trowel device 10 is preferably resting on its safety stand 20 on the roof or other flat, substantially horizontal surface, although it may also be held in one hand of its operator. The gas flow valve 18 is turned on and the burner or burner jet 16 is then ignited, as by a conventional spark device. The trowel blade 16 is allowed to come to operating temperature, after which, with a firm grip on hand grip 38, the hot trowel 10 is begun to be applied to the edge sealing operation. At a location of oozed-out material 52, from the seam between overlying sheets 48 and 50, one of the relatively sharp edges depending from or diverging rearwardly from the nose corner 22 of trowel blade 12 is appropriately applied to the location of the oozed-out material, and with a scraping motion, is swept back toward the exposed edge of top sheet 50. Then, while continuously working the hot trowel device 10 with sweeping, scraping motions, the initial zone or area of oozed-out material and adjacent or subsequent such zones are progressively worked toward and into the exposed seam line or edge of sheet 50 to provide a smooth, continuous and finished seam therealong. As implied above, either of the two sharp edges of the trowel blade 12 that extend rearwardly, as viewed by the operator, from its nose corner 22, as well as the nose corner 22 itself, may be employed during the foregoing finishing operations, depending upon the requirements of the particular situation presented by the oozed-out material encountered.

Also, in a relatively short zone along the exposed seam edge where there may be no oozed-out material and none is available from the adjacent zone and, in addition, an independent supply, as from the container thereof, is not deemed to be required, the broad bottom area of the hot trowel blade 12 may be applied to such zone to create, for example, some oozing of heat-sealable modified-bitumen material which may then be worked back toward and into the seam to produce the desired seam finish. Moreover, an independent supply of heat-sealable material, as mentioned above, may be employed, as required, in conjunction with the hot trowel of this invention, to effect a desired finished seal of the roofing sheet material. It is contemplated that use of the latter-mentioned expedient is most apt to occur in such seam finishing operations as arise in locations characterized by flashing at chimneys, skylights, vent pipes, perimeter walls and the like. In this connection, it is of particular note to point out that the hot trowel device of this invention is as easily and efficiently usable for seaming vertical or steeply inclined surfaces, e.g., flashed surfaces, as for seaming horizontal or low slope surfaces, e.g., a roof covering. This, of course, is not true of sealing devices such as those of the cited prior art patents. By continuously and repeatedly carrying out seam finishing operations in the foregoing manner, there is produced a substantially improved, weatherproof seal.

It will be apparent that the hot trowel device 10 of this invention may be conveniently placed in an at-rest position and the sealing operations mentioned above temporarily discontinued at will, by the mere expedient of resting the hot-trowel device on its safety stand 20. Also, having proceeded, as aforesaid, with the finishing of seams and the task having been accomplished, the gas flow valve 18 may be turned off and the hot trowel device placed in its at-rest position on its safety stand 20 or, alternatively, the hot trowel device 10 may be first placed in an at-rest position before valve 18 is turned off.

In connection with the foregoing description of the apparatus and method of this invention, it should be apparent that the shape or size of trowel blade 12, though encompassing a preferred embodiment, is not considered critical and other shapes and sizes may be used in the practice of this invention. Moreover, it should be noted that a choice or selection of other shapes or sizes of trowel blade 12 is readily accommodated by the invention, by the practical expedient of permitting removal of the shown trowel blade and attached support arm and replacing it with a similar subassembly having a trowel blade of the desired size and/or shape.

Although the present invention has been shown and described in connection with a certain embodiment, it will be readily apparent to those skilled in the art that various changes in form and arrangement of parts may be made to suit specific requirements without departing from the spirit and scope of the invention.

I claim as my invention:

1. A hot trowel device, particularly adapted for sealing and finishing lapped edge seams, flashed edges and the like in constructions employing heat-sealable roofing sheets and heat-sealable adhesive material, said hot trowel device comprising:

a substantially flat trowel blade which comprises a pointed, relatively thin, metal member attached to an offset support arm, a blade-heating means operatively connected to said trowel blade, said blade-heating means being a gas burner directing flames onto an upper surface of said trowel blade, handle means for hand lifting and hand manipulating said trowel blade and connected heating means for edge heat-sealing and finishing of said roofing sheets, and said device further including means to vary selectively the spacing between said blade and said heating means which includes a collar member adjacent to said handle for receiving and securing said offset arm.

2. A device as defined in claim 1, which further includes safety stand means for supporting said blade and heating means at an elevation above horizontal.

3. A device as defined in claim 2, which further includes hand grip means on said handle means.

* * * * *